US011377621B2

(12) United States Patent
Sirovski et al.

(10) Patent No.: US 11,377,621 B2
(45) Date of Patent: Jul. 5, 2022

(54) METHOD FOR PRODUCTION OF FATTY ACIDS

(71) Applicant: SLGK ZAKLAD BADAWCZO-WDROZENIOWY PROCESÓW CHEMICZNYCH SPÓLKA Z OGRANICZONA ODPOWIEDZIALNOSCA, Bydgoszcz (PL)

(72) Inventors: Felix Samuel Sirovski, Canterbury (GB); Henryk Lisaj, Ilawa (PL); Jerzy Stanislaw Grzesiak, Bydgoszcz (PL); Mieczyslaw Karwowski, Warsaw (PL)

(73) Assignee: SLGK ZAKLAD BADAWCZO-WDROZENIOWY PROCESÓW CHEMICZNYCH SPÓLKA Z ORGANICZONA ODPOWIEDZIALNOSCIA, Bydgoszcz (PL)

( * ) Notice: Subject to any disclaimer, the term of this patent is extended or adjusted under 35 U.S.C. 154(b) by 0 days.

(21) Appl. No.: 16/641,246

(22) PCT Filed: Sep. 8, 2018

(86) PCT No.: PCT/EP2018/074236
§ 371 (c)(1),
(2) Date: Feb. 23, 2020

(87) PCT Pub. No.: WO2019/048655
PCT Pub. Date: Mar. 14, 2019

(65) Prior Publication Data

US 2020/0291326 A1 Sep. 17, 2020

(30) Foreign Application Priority Data

Sep. 10, 2017 (GB) ..... 201714542
Sep. 10, 2017 (GB) ..... 201809592

(51) Int. Cl.
*C11B 13/02* (2006.01)
*C11C 1/02* (2006.01)
*C11C 1/04* (2006.01)

(52) U.S. Cl.
CPC ..... *C11B 13/02* (2013.01); *C11C 1/025* (2013.01); *C11C 1/04* (2013.01)

(58) Field of Classification Search
CPC ..... C11C 1/00; C11C 1/025; C11B 13/02
See application file for complete search history.

(56) References Cited

U.S. PATENT DOCUMENTS 353,566 A * 11/1886 Lackersteen ..... C25B 3/02 205/440
2,033,732 A * 3/1936 Neiss ..... C11B 13/02 205/440

(Continued)

FOREIGN PATENT DOCUMENTS

WO 93/03815 A1 3/1993
WO WO-9303815 A1 * 3/1993 ..... B01D 17/06

(Continued)

OTHER PUBLICATIONS

Mohammed Sakr et.al. A comprehensive review on applications of ohmic heating. Renewable and Sustainable Energy Reviews,2014, 262-269, v.39, Elsevier Ltd, UK.

*Primary Examiner* — Yate' K Cutliff
(74) *Attorney, Agent, or Firm* — Burr & Brown, PLLC

(57) ABSTRACT

A process for production fatty acids comprising: adjusting pH of a saponifiable material to a value above pH 7 by adding alkaline material; saponifying all saponifiable material by passing alternate electrical current through the material, wherein the said step of saponification occurs in a saponification reactor; acidulating the saponified material by (Continued)

adding acid to pH value below 4; isolating obtained free fatty acids from aqueous layer.

13 Claims, 2 Drawing Sheets

(56) References Cited

U.S. PATENT DOCUMENTS

| | | | | |
|---|---|---|---|---|
| 3,708,513 | A | 2/1973 | Wechsler | |
| 4,118,407 | A | 3/1978 | Red | |
| 7,722,755 | B2 * | 5/2010 | Lawson | C07C 51/09 205/440 |
| 9,546,342 | B1 | 1/2017 | Sutterlin | |
| 2017/0204344 | A1 * | 7/2017 | Lewis | C02F 1/385 |

FOREIGN PATENT DOCUMENTS

| | | | | |
|---|---|---|---|---|
| WO | 2016/149692 | A1 | 9/2016 | |
| WO | WO-2016149692 | A1 * | 9/2016 | C07C 51/15 |

* cited by examiner

METHOD FOR PRODUCTION OF FATTY ACIDS

CROSS-REFERENCE TO RELATED APPLICATIONS

This application is a National Phase of International Application No. PCT/EP2018/074236 having an international filing date of Sep. 8, 2018, published in English on Mar. 14, 2019, which claims the benefit under 35 U.S.C. 119 sections (a)-(d) of Application No. GB 201714542.6 (filed Sep. 10, 2017) and Application No. GB 201809592.7 (filed Sep. 10, 2017), the entireties of which are incorporated herein by reference.

BACKGROUND a. Field of the Invention

The present invention generally provides a process for treating a soapstock.

This invention particularly provides a systems and methods for realising the full free fatty acid yield of a soapstock by first converting substantially all of the saponifiable material in a soapstock to salts of fatty acids (soaps) and acidulating the soaps to generate free fatty acids, wherein the soapstock comprises soaps, saponifiable lipids, e.g. glycerides and phospholipids and the generating of free fatty acids is achieved by passing an alternating electric current through a soapstock.

b. Related Art

Crude (unrefined) animal and vegetable oils (referred to herein collectively as "natural oils") are typically subjected to a variety of processing steps to remove specific undesirable components of the crude oil prior to sale. The type, number, and sequencing of processing steps can vary depending on the crude oil feedstock, refinery type (e.g. physical vs. alkaline) and configuration, target product markets, and the like. In general, crude natural oils are refined to remove excess quantities of "gums" (comprised primarily of phospholipids), free fatty acids, as well as various colouring components and volatile compounds.

In most natural oil refineries utilizing the chemical refining process, phosphoric acid or an equivalent acid is added to the crude oil to increase the solubility of the phospholipids (gums) in water. Next, a strong base, typically sodium hydroxide (NaOH) is added, reacting with the free fatty acids in the oil to form soaps (salts of free fatty acids). Water is then added to the oil to remove the soaps and solubilized gums. Soapstock is typically acidulated to generate free fatty acids. Gums are typically sold into low-value animal feed markets U.S. Pat. No. 9,546,342 describes a process for treating a soapstock. The mixed lipid feedstock is combined with a base to form a first mixture. The first mixture is allowed to react. Carbon dioxide is introduced into the reacted mixture in the reaction vessel to form a first carbonic acid within the reaction vessel. The first carbonic acid is mixed with the reacted mixture within the reaction vessel. The first carbonic acid and reacted mixture are allowed to settle within the reaction vessel. A first aqueous layer is drained from the reaction vessel, thereby acidulating soaps in the first mixture to generate free fatty acids.

However, the method cited above requires quite substantial reaction time. The first step only proceeds for 4 hours that makes this method hardly suitable for continuous production.

SUMMARY OF THE INVENTION

Aspects of the invention are specified in the independent claims. Preferred features are specified in the dependent claims.

The object of the present invention to provide an improvement which overcomes the inadequacies of the prior art methods and which is a significant contribution to the advancement to achieving the full fatty acid yield of saponifiable material.

BRIEF DESCRIPTION OF THE DRAWINGS

The present invention will now be further described, by way of example, with reference to the following figures, in which.

Figure 1:
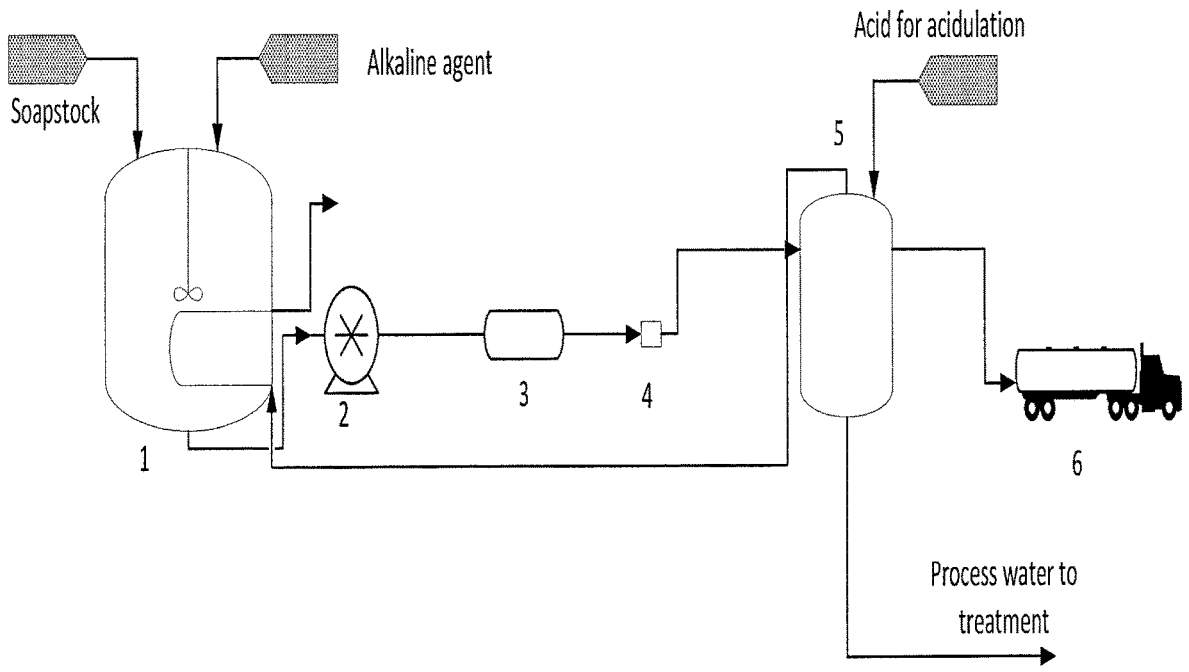
FIG. 1 is a flow diagram of an exemplary method of the invention comprising generating free fatty acids from a mixed lipid feedstock comprising soaps, saponifiable material or equivalents thereof. The following detailed description is provided to give the reader a better understanding of certain details of aspects and embodiments of the invention, and should not be interpreted as a limitation on the scope of the invention.

The drawings included in the present application are incorporated into, and form part of the specification. They illustrate embodiments of the present disclosure and, along with the description, serve to explain the principles of the disclosure. The drawings are only illustrative of certain embodiments and do not limit the disclosure.

Definitions

As used herein, the term saponifiable material is intended to mean by product streams of natural oil processing, i.e soapstock, gums, phospholipids or mixtures thereof, glycerides (mono-, di- and triglycerides), black liquor soaps or tall oil soaps.

DETAILED DESCRIPTION

In alternative embodiments, the invention provides processes for the preparation of fatty acids from mixed lipid feedstocks comprising saponifiable material, including by-product streams of natural oil processing e.g. soapstocks, gums, or mixtures thereof. In alternative embodiments, the feedstock comprises soapstock obtained from the alkaline neutralisation of crude natural oil. In alternative embodiments, the feedstock comprises the gums product (comprising primarily phospholipids) generated during the degumming of a natural oil. In alternative embodiments, the feedstock comprises a mixture of product streams generated during the processing of crude natural oil and comprises soaps as well as saponifiable lipids, e.g. phospholipids glycerides, e.g. mono-, di-, and/or triglycerides, or any combination thereof. In alternative embodiments, processes of the invention are more economical and efficient than currently used approaches for the treatment of natural oil processing by-products e.g. soapstocks and gums, to generate fatty acids.

The most surprising and unexpected result was that passing alternate electric current through the slightly alkaline soapstock results in the rapid saponification of triglycerides and phospholipids with the generation of alkaline salts of free fatty acids.

In alternative embodiments, a mixed lipid feedstock, e.g. a soapstock comprising soaps as well as saponifiable material (e.g. glycerides and/or phospholipids) is heated and its pH is adjusted to above 7. Thus prepared soapstock is subjected to the action of an alternative electric current and reacts with a base in a saponification reactor to convert the saponifiable material to soaps (salts of fatty acids), thereby generating a product in which substantially all of the saponifiable material is converted to soaps. The soaps present in the product stream generated in the foregoing saponification step are then separated and reacted with an acid in a second acidulation step of the process in which substantially all of the soaps are acidulated to form free fatty acids (i.e. fatty acids with no ester moiety) and an inorganic sodium or calcium salt, if sodium hydroxide or calcium hydroxide are the selected bases used in the saponification step.

Crude (unrefined) natural oils, including plant- and animal-derived oils, are comprised primarily of triacylglycerols (i.e. triglycerides), as well as smaller portions of various lipids including mono- and diacyleglycerols, (i.e. monoglycerides and di-glycerides, respectively), free fatty acids, phospholipids, waxes, and other non-lipid components including, for example, ketones, aldehydes, and hydrocarbons. Prior to sale for human consumption or for further processing, a crude natural oil is usually refined to remove the majority of the non-triglyceride components. The majority of natural oils are refined using the chemical refining process. In the first stage of the chemical refining process, referred to as "degumming", crude oils are first washed with water to remove the hydratable phospholipids (gums). The resulting product stream separated from the oil during the degumming step is referred to as "gums." Second, the degummed oils are subjected to a neutralisation step in which the degummed oil is treated with a strong base, e.g. sodium hydroxide. During the neutralisation step, free fatty acids present in the oil react with the base to form soaps (salts of fatty acids). In some refineries, there is an additional processing step between the degumming and neutralisation step in which a small amount of a mineral acid, e.g. phosphoric acid or citric acid) is added to the degummed oil to convert any non-hydratable phospholipids into hydrated phospholipids. After the neutralisation step, the oil is washed to remove the soaps and, if the oil was treated with a mineral acid, the hydrated phospholipids. The resulting product stream separated from the oil during the neutralisation step is referred to as "soapstock." If the oil is to be sold for human consumption, the degummed, neutralised oil is then subjected to further processing including, e.g. bleaching and deodorisation steps.

Depending on the configuration of the refinery, soapstock and gums are either stored separately or combined into a single storage container. When referred to herein, a "mixed lipid feedstock" refers to any material or composition comprising soaps as well saponifiable material, i.e. lipids capable of reacting to produce soaps (salts of fatty acids). Saponifiable material in the mixed lipid feedstock can include, without limitation, glycerides, e.g. mono-glycerides, di-glycerides, or triglycerides, or a combination thereof, and/or phospholipids. In alternative embodiments, the mixed lipid feedstock is a soapstock. In alternative embodiments, the mixed lipid feedstock comprises soaps and saponifiable lipids e.g. glycerides and/or phospholipids. In alternative embodiments, the mixed lipid feedstock is a mixture of soapstocks, comprising soaps, saponifiable material, e.g. glycerides and/or phospholipids, obtained during the processing of a natural oil. In alternative embodiments, the mixed lipid feedstock is a soapstock washwater obtained from the processing of a crude natural oil following the neutralisation step in the chemical refining process. In such embodiments, the washwater can comprise water and soapstock, wherein the soapstock comprises soaps, glycerides, phospholipids, free fatty acids, and unsaponifiable material e.g. waxes and/or sterols. In alternative embodiments, the soapstock washwater can comprise between about 1% soapstock to about 90% soapstock, e.g. between about 2% and 80% soapstock, about 3% and 70% soapstock, about 4% and about 60% soapstock, about 5% and about 50% soapstock, about 6% and about 40% soapstock, about 7% and about 30% soapstock, about 8% and about 20% soapstock, about 9% and about 15% soapstock, or between about 20% and about 12% soapstock, the remaining portion of the soapstock washwater comprising water. The composition of the soapstock used as a mixed lipid feedstock in accordance with the present invention can vary depending on the crude natural oil from which it was derived.

Other mixed lipid feedstocks suitable for use in the present process include tall oil soaps. Tall oil soaps are generated via the alkaline pulping of wood in the Kraft process. The alkaline pulping of wood using the Kraft process results in the production of black liquor, comprising the majority of the non-cellulose components of the wood. These products include hemicelluloses, lignin, and various salts of carboxylic acids including rosin salts and soaps (salts of fatty acids). After the black liquor is concentrated using multiple effect evaporators, it is allowed to settle or is centrifuged. As the concentrated black liquor settles, the soaps float to the surface where they are skimmed and removed. The skimmed product (referred to as black liquor soaps or tall oil soaps) is used as a feedstock in various embodiments of the process.

In alternative embodiments, the mixed lipid feedstock in the present process is a saponified crude natural oil, e.g. a saponified vegetable oil. In alternative embodiments, the mixed lipid feed feedstock is a saponified castor oil, i.e. a composition comprising soaps derived from mixing a base with a castor oil, the saponifiable content in the castor oil, e.g. glycerides, and phospholipids, having been converted to soaps. It is known in that the majority of the fatty acid content in castor oil (e.g. between 80 to about 95% of the fatty acid content) is ricinoleic acid (12-hydroxy-9-cz's-octadecenoic acid). In alternative embodiments, the invention provides methods or processes for generating ricinoleic acid by first saponifying a castor oil by adding a base, e.g. sodium hydroxide, to the castor oil, passing alternate electric current through the obtained mixture, acidulating the saponified castor oil to generate free fatty acids, and then separating or isolating ricinoleic acid from the generated free fatty acids.

FIG. 1 shows an exemplary embodiment of the process for generating free fatty acids from a soapstock. A soapstock comprising soaps and unsaponified lipids is first combined with a strong base, e.g. sodium hydroxide in the vessel 1 (soap stock tank). The resulting combination is pumped by a positive displacement pump 2 to a saponification reactor 3, where it is subjected to the action of an alternate electric current wherein substantially all of the saponifiable material in the soapstock is converted to soaps, glycerine and other products. From the saponification reactor 3 the obtained mixture is directed through a pressure regulation means 4 to a clarifier 5 (and the resulting product can be transported, e.g., by a finished product tanker 6). The steam from the clarifier is used to preheat a soapstock in the tank 1. The soaps in water are then contacted with an acid which acidulates the soaps in an acidulation reaction to generate free fatty acids.

Alternative embodiments of the methods and processes are described in greater detail bellow.

Soapstock Saponification:

In alternative embodiments, the first stage of the process is a saponification reaction of a mixed lipid feedstock with alkaline material under the action of an alternate electric current. In alternative embodiments, a mixed lipid feedstock, e.g. a soapstock washwater comprising water, soaps as well as saponifiable material e.g. glycerides (e.g. mono- di- or triglycerides or any combination thereof) and phospholipids, is mixed with a base, e.g. a strong base such as sodium hydroxide or potassium hydroxide, and water to generate a saponification reaction mixture. The generated saponification reaction mixture is then subjected to the action of an alternate electric current to convert substantially all of the saponifiable material in the mixed lipid feedstocks to soaps. During the saponification reaction, the base serves to cleave substantially all of the ester bonds of the saponifiable lipids present in the mixed lipid feedstock and the cation (e.g. sodium, potassium or calcium) joins the fatty acid molecule to form a salt of a fatty acid (soap). The resulting product comprises soaps as well as water-soluble material e.g. glycerine.

The following is a reaction scheme showing the saponification of a glyceride molecule in the mixed lipid feedstock in an exemplary embodiment of the present invention.

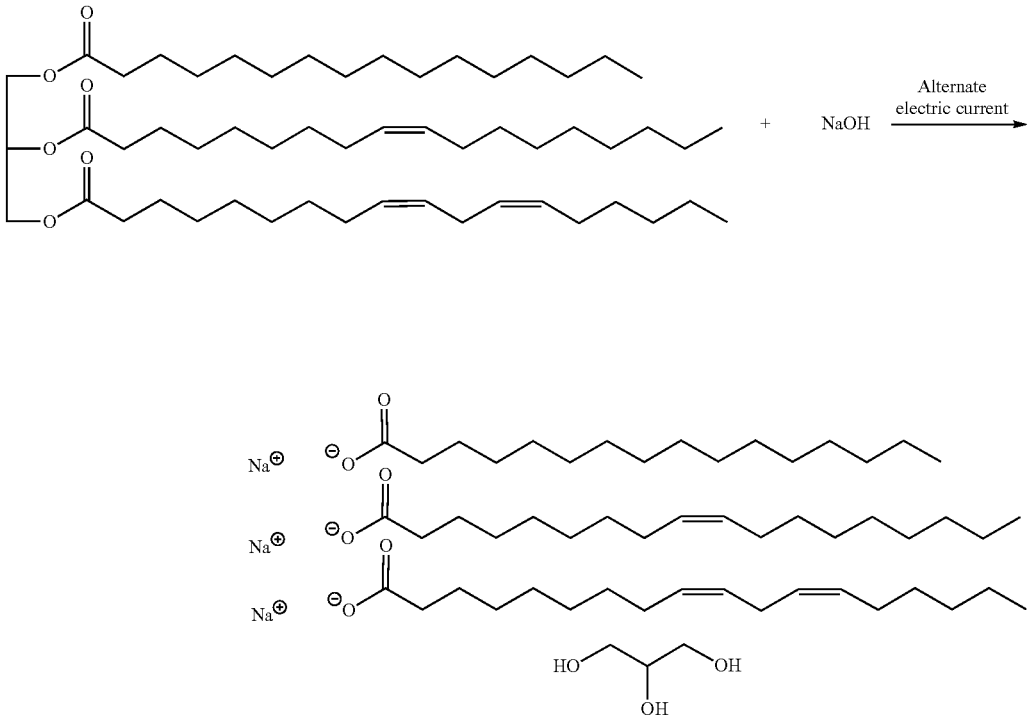

The following is a reaction scheme showing the saponification of a phospholipid molecule in the mixed lipid feedstock in an exemplary embodiment of the present invention.

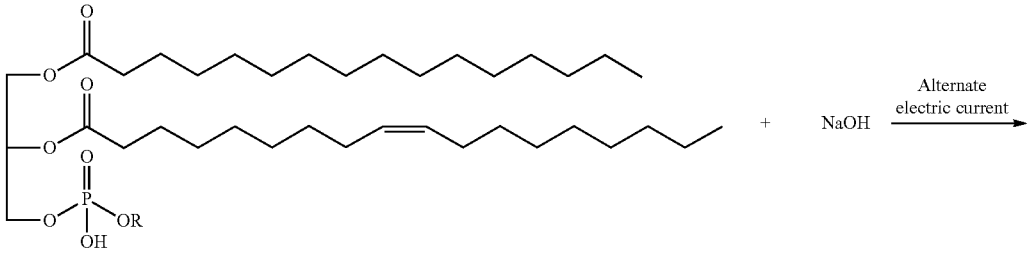

-continued

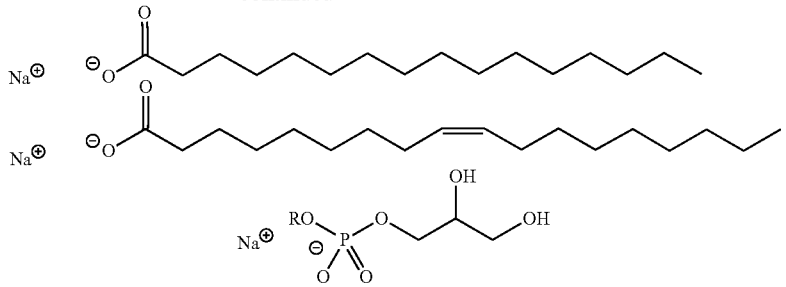

In alternative embodiments the frequency of an alternate electric current is in the range from 50 Hz to 10,000 Hz or from 50 Hz to 1000 Hz or from 50 Hz to 60 Hz.

In alternative embodiments, the saponification reaction is carried out at a temperature in the range of between about room temperature (i.e. around 20-25° C.) to 150° C. e.g. between 50° C. to 140° C., 60° C. to 120° C.

In alternative embodiments, the saponification reaction is carried out at a pressure of between 0 to 5 barg, e.g. between 1 and 4 barg, or between 1.5 psig and 3 psig. In alternative embodiments, the saponification reaction is carried out at ambient pressure.

In alternative embodiments, the base used in the saponification reaction is any base of hydroxide, e.g. sodium hydroxide (NaOH), potassium hydroxide (KOH) or calcium hydroxide ($Ca(OH)_2$).

In certain embodiments, following the saponification reaction, the resulting reaction products (i.e. the saponification product mixture) are subjected to a separation step in which the soaps are separated from the reaming reaction products, e.g. glycerine. The separation step can be any suitable separation technique known in the art, e.g. filtration, centrifugation, water washing, or any combination of separation techniques. In an exemplary embodiment, the reaction products from the saponification step are allowed to settle and then the soaps are skimmed from the surface of the mixture. In alternative embodiments, the skimmed soaps are then subjected to a water wash in which substantially all of the non-soap material is removed from the soaps.

In alternative embodiments saponification step is carried out in an ohmic heater.

In alternative embodiments saponification step is carried out in a reactor described below.

Ohmic heaters as described in the paper "A comprehensive review on applications of ohmic heating (OH)" by Mohamed Sakr, Shuli Liu published in Renewable and Sustainable Energy Reviews 39(2014) 262-269, DOI 10.1016/j.rser.2014.07.061 or elsewhere can be used as saponification reactors for passing alternative electric current through the soapstock. However the preferable is the reactor shown in FIG. 2 and described further herein.

The process is preferably carried out in a continuous manner, for example, by pumping the feedstock reaction mixture through a sufficiently long ohmic heater or the reactor described below. Alternatively, it can be carried out as a batch process.

Instead of a conventional ohmic heater described elsewhere the exemplary construction of the saponification reactor is described below.

Figure 2:
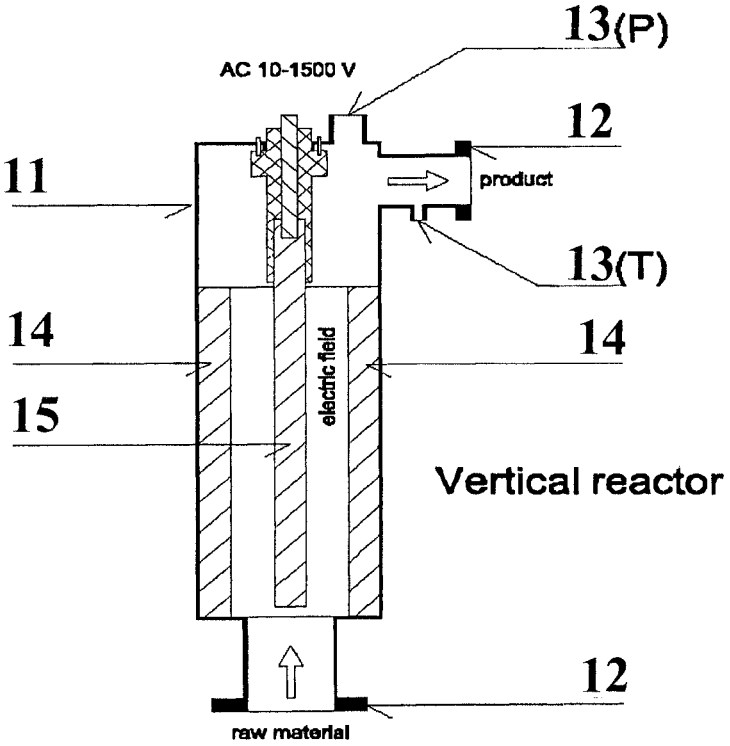
FIG. 2 shows the exemplary reactor schematics.

The exemplary reactor chart is shown in FIG. 2.

The reactor consists of a pressure vessel 11 that could be manufactured from a suitable material required to withstand pressure, (for example stainless steel 316L) with hydraulic connections 12 (in case of a continuous process) and sensors for pressure and temperature, 13. Inside this casing is a tube 14 made of electrically conductive material (steel, graphite or other analogous suitable material) connected mechanically and electrically to the casing. The diameter and length of the tube is determined by a soapstock conversion requirements. The tube 14 is a zero (neutral) electrode. In the center of the reactor is placed the phase electrode 15 made of electrically conductive material (steel, graphite or other suitable material). This electrode could be a rod or a hollow pipe cooled by the converted material. This electrode is electrically isolated from the housing and internal graphite tube. For the reactor operations requiring power greater than 20 kW, a three-reactor system in parallel or in series configuration is used in order to ensure a uniform load on the network.

In alternative embodiments pluralities of three reactor assemblies could be employed depending on the required capacity.

It will be appreciated that any suitable techniques may be employed in the process; for example as a pressure regulation means ball valves, gate valves or a positive displacement pump operating at a lower speed than positive displacement pump 2 in FIG. 1 can be used. Suitable device will be well known per se to those skilled in the art.

Acidulation of Soaps:

In alternative embodiments, the soaps, or the reaction product generated during the saponification step of the process (i.e. the saponification product mixture), is subjected to an acidulation step in which substantially all of the soaps are acidulated to generate free fatty acids. The soaps are acidulated by mixing them in any suitable reaction vessel with an acid to form an acidulation reaction mixture. In alternative embodiments acid used for acidulation is hydrochloric acid (HCl) or sulphuric acid ($H_2SO_4$).

In alternative embodiments, the desired pH of the acidulation reaction mixture is below 7, i.e. in the range of 2-6, preferably 4.5-5.5.

It should be understood, however, that the intention is not to limit the invention to the particular embodiments described. On the contrary, the intention is to cover all modifications, equivalents, and alternatives falling within the spirit and scope of the invention.

The invention is illustrated by the following examples. The examples are intended for illustration only and the present invention is not any way limited by the examples.

EXAMPLE 1

Phospholopids (3 kg) were loaded to the reactor that was described above. Then the reactor was sealed and the process started. The current frequency was 50 Hz.

After saponification reaction mixture was acidulated with hydrochloric acid to pH below 4. Free fatty acids were immediately separated as a top layer.

The residue after hydrolysis was saponificated again, no free fatty acids were detected. That proved the completeness of the saponification.

The control sample was treated in the same way without application of an electric current. No free fatty acids were separated.

The process parameters are listed in the table below.

| Time, hr: min | Current, A | Voltage, V | Power, Wt | Temperature ° C. | Pressure, barg | Notes |
|---|---|---|---|---|---|---|
| 00:00:00 | 0.0 | 0.0 | 0.0 | 49 | 0.00 | Reactor loading |
| 00:01:00 | 24.1 | 51.0 | 1229.1 | 49 | 0.00 | Start |
| 00:02:00 | 28.0 | 49.1 | 1374.8 | 58 | 0.00 | |
| 00:03:00 | 28.8 | 47.9 | 1379.5 | 58 | 0.00 | |
| 00:04:00 | 26.2 | 47.9 | 1255.0 | 59 | 0.00 | Reactor full |
| 00:05:00 | 30.0 | 51.7 | 1551.0 | 55 | 0.00 | Manual voltage control |
| 00:06:00 | 34.0 | 49.8 | 1693.2 | 56 | 0.00 | |
| 00:07:00 | 33.3 | 53.1 | 1768.2 | 62 | 0.00 | |
| 00:08:00 | 29.0 | 56.0 | 1624.0 | 66 | 0.00 | Manual voltage control |
| 00 09 00 | 29.0 | 56.0 | 1624.0 | 72 | 0.00 | |
| 00:10:00 | 0.0 | 0.0 | 0.0 | 89 | 0.00 | Stopping |
| 00:11:00 | 0.0 | 0.0 | 0.0 | | | |
| 00:12:00 | 0.0 | 0.0 | 0.0 | | | Start |
| 00:13:00 | 50.0 | 49.1 | 2455.0 | 73 | 0.00 | |
| 0014:00 | 47.7 | 49.8 | 2375.5 | 76 | 0.00 | |
| 0015:00 | 44.4 | 50.8 | 2255.5 | 79 | 0.00 | |
| 0016:00 | 43.5 | 51.7 | 2249.0 | 88 | 0.80 | |
| 0017:00 | 41.2 | 51.9 | 2138.3 | 101 | 1.80 | |
| 0018:00 | 42.8 | 51.2 | 2191.4 | 111 | 2.80 | |
| 0019:00 | 43.2 | 51.0 | 2203.2 | 120 | 3.60 | |
| 00:20:00 | 41.9 | 51.7 | 2166.2 | 126 | 4.00 | |
| 00:21:00 | 40.0 | 51.6 | 2064.0 | 127 | 4.40 | |
| 00:22:00 | 0.0 | 0.0 | 0.0 | 130 | 2.80 | |
| 00:23:00 | 30.0 | 46.0 | 1380.0 | 133 | 4.50 | |
| 00:24:00 | | | 0.0 | 138 | | Stopping |
| 00:25:00 | 45.0 | 51.0 | 2295.0 | 136 | 4.00 | Start |
| 00:26:00 | 33.0 | 47.0 | 1551.0 | 138 | 5.00 | |
| 00:27:00 | | | 0.0 | 139 | 4.30 | |

EXAMPLE 2

Soapstock (3 kg) was loaded to the reactor that was described above. Then the reactor was sealed and the process started. The current frequency was 60 Hz.

After saponification reaction mixture was acidulated with sulphuric acid to pH below 4. Free fatty acids were immediately separated as a top layer.

The residue after hydrolysis was saponificated again, no free fatty acids were detected. That proved the completeness of the saponification.

The process parameters are listed in the table below.

| Time, hr: min | Current, A | Voltage, V | Power, Wt | Temperature ° C. | Pressure, barg | Notes |
|---|---|---|---|---|---|---|
| 00:00:00 | 41.0 | 18.0 | 738.0 | 33 | 0.00 | |
| 00:01:00 | 42.5 | 12.5 | 531.3 | 33 | 0.00 | |
| 00:02:00 | 43.0 | 11.9 | 511.7 | 35 | 0.00 | |
| 00:03:00 | 43.1 | 11.3 | 487.0 | 38 | 0.00 | |
| 00:04:00 | 43.2 | 11.0 | 475.2 | 40 | 0.00 | |

-continued

| Time, hr: min | Current, A | Voltage, V | Power, Wt | Temperature ° C. | Pressure, barg | Notes |
|---|---|---|---|---|---|---|
| 00:05:00 | 43.3 | 10.6 | 459.0 | 42 | 0.00 | |
| 00:06:00 | 43.4 | 10.5 | 455.7 | 43 | 0.00 | |
| 00:07:00 | 43.5 | 10.3 | 448.1 | 44 | 0.00 | |
| 00:08:00 | 43.4 | 10.0 | 434.0 | 46 | 0.00 | |
| 00:09:00 | 43.4 | 9.8 | 425.3 | 48 | 0.00 | |
| 00:10:00 | 43.4 | 9.7 | 421.0 | 50 | 0.00 | |
| 00:11:00 | 43.4 | 9.6 | 416.6 | 51 | 0.00 | |
| 00:12:00 | 43.5 | 9.4 | 408.9 | 52 | 0.00 | |
| 00:13:00 | 43.5 | 9.3 | 404.6 | 54 | 0.00 | |
| 00:14:00 | 43.5 | 9.2 | 400.2 | 55 | 0.00 | |
| 00:15:00 | 43.5 | 9.1 | 395.9 | 56 | 0.00 | |
| 00:16:00 | 43.5 | 9.0 | 391.5 | 57 | 0.00 | |
| 00:17:00 | 43.6 | 8.9 | 388.0 | 58 | 0.00 | |
| 00:18:00 | 43.7 | 8.8 | 384.6 | 60 | 0.00 | |
| 00:19:00 | 43.6 | 8.7 | 379.3 | 61 | 0.10 | |
| 00:20:00 | 43.7 | 8.6 | 375.8 | 62 | 0.30 | |
| 00:21:00 | 43.7 | 8.4 | 367.1 | 63 | 0.40 | |
| 00:22:00 | 43.6 | 8.4 | 366.2 | 64 | 0.40 | |
| 00:23:00 | 43.6 | 8.3 | 361.9 | 65 | 0.50 | |
| 00:24:00 | 43.8 | 8.3 | 363.5 | 66 | 0.60 | |
| 00:25:00 | 44.0 | 8.3 | 365.2 | 68 | 0,,7 | |
| 00:26:00 | 43.8 | 8.3 | 363.5 | 69 | 0.70 | |
| 00:27:00 | 43.6 | 8.2 | 357.5 | 71 | 0.80 | |
| 00:28:00 | 43.6 | 8.1 | 353.2 | 72 | 0.90 | |
| 00:29:00 | 43.6 | 8.1 | 353.2 | 72 | 0.90 | |
| 00:30:00 | 43.7 | 8.0 | 349.6 | 72 | 0.90 | |
| 00:31:00 | 43.6 | 8.0 | 348.8 | 73 | 1.00 | |
| 00:32:00 | 43.4 | 7.9 | 342.9 | 75 | 1.10 | |
| 00:33:00 | 43.7 | 7.9 | 345.2 | 76 | 1.10 | |
| 00:34:00 | 43.5 | 7.8 | 339.3 | 77 | 1.20 | |
| 00:35:00 | 43.7 | 7.8 | 340.9 | 78 | 1.20 | |
| 00:36:00 | 43.5 | 7.8 | 339.3 | 79 | 1.30 | |
| 00:37:00 | 43.6 | 7.7 | 335.7 | 80 | 1.30 | Taking first sample and acidulation |
| 00:38:00 | 43.5 | 8.4 | 365.4 | 81 | 0.60 | |
| 00:39:00 | 43.5 | 8.4 | 365.4 | 82 | 0.60 | |
| 00:40:00 | 43.2 | 9.0 | 388.8 | 82 | 0.50 | Second sample, alkalinisation |
| 00:41:00 | 43.2 | 9.0 | 388.8 | 83 | 0.50 | |
| 00:42:00 | 43.3 | 8.9 | 385.4 | 85 | 0.50 | |
| 00:43:00 | 43.3 | 8.8 | 381.0 | 87 | 0.50 | |
| 00:44:00 | 43.3 | 8.8 | 381.0 | 88 | 0.50 | |
| 00:45:00 | 43.4 | 8.8 | 381.9 | 89 | 0.50 | |
| 00:46:00 | 43.2 | 8.6 | 371.5 | 91 | 0.50 | |
| 00:47:00 | 43.3 | 8.6 | 372.4 | 92 | 0.50 | |
| 00:48:00 | 43.4 | 8.5 | 368.9 | 93 | 0.60 | |
| 00:49:00 | 43.3 | 8.5 | 368.1 | 93 | 0.60 | |
| 00:50:00 | 43.2 | 8.4 | 362.9 | 94 | 0.70 | |
| 00:51:00 | 43.2 | 8.4 | 362.9 | 95 | 0.70 | |
| 00:52:00 | 45.2 | 8.3 | 375.2 | 96 | 0.75 | |
| 00:53:00 | 45.2 | 8.3 | 375.2 | 97 | 0.80 | |
| 00:54:00 | 45.8 | 8.2 | 375.6 | 98 | 0.90 | |
| 00:55:00 | 44.1 | 8.2 | 361.6 | 98 | 0.90 | |
| 00:56:00 | 44.0 | 8.2 | 360.8 | 99 | 1.00 | |
| 00:57:00 | 44.1 | 8.1 | 357.2 | 100 | 1.00 | |
| 00:58:00 | 44.1 | 8.5 | 374.9 | 101 | 0.95 | Third sample |
| 00:59:00 | 44.1 | 8.4 | 370.4 | 101 | 0.95 | |
| 01:00:00 | 44.1 | 8.4 | 370.4 | 102 | 1.00 | |
| 01:01:00 | 44.1 | 8.4 | 370.4 | 103 | 1.00 | |
| 01:02:00 | 44.1 | 8.4 | 370.4 | 104 | 1.00 | |
| 01:03:00 | 44.0 | 8.4 | 369.6 | 105 | 1.00 | |
| 01:04:00 | 44.0 | 8.3 | 365.2 | 105 | 1.00 | |
| 01:05:00 | 44.1 | 8.3 | 366.0 | 106 | 1.10 | |
| 01:06:00 | 44.0 | 8.3 | 365.2 | 107 | 1.10 | |
| 01:07:00 | 44.1 | 8.2 | 361.6 | 108 | 1.15 | |
| 01:08:00 | 44.0 | 8.2 | 360.8 | 108 | 1.15 | |
| 01:09:00 | 44.0 | 8.2 | 360.8 | 109 | 1.20 | |
| 01:10:00 | 43.9 | 8.1 | 355.6 | 110 | 1.20 | |
| 01:11:00 | 43.5 | 8.1 | 352.4 | 110 | 1.20 | |

-continued

| Time, hr: min | Current, A | Voltage, V | Power, Wt | Temperature ° C. | Pressure, barg | Notes |
|---|---|---|---|---|---|---|
| 01:12:00 | 43.3 | 8.0 | 346.4 | 111 | 1.25 | |
| 01:13:00 | 43.4 | 8.0 | 347.2 | 111 | 1.30 | |
| 01:14:00 | 43.9 | 8.0 | 351.2 | 112 | 1.30 | |
| 01:15:00 | 43.8 | 8.0 | 350.4 | 113 | 1.35 | |
| 01:16:00 | 43.9 | 8.0 | 351.2 | 113 | 1.35 | |
| 01:17:00 | 43.8 | 8.0 | 350.4 | 114 | 1.40 | |
| 01:18:00 | 44.0 | 8.0 | 352.0 | 114 | 1.40 | |
| 01:19:00 | 44.3 | 7.9 | 350.0 | 115 | 1.40 | |
| 01:20:00 | 44.1 | 7.9 | 348.4 | 115 | 1.40 | |
| 01:21:00 | 44.4 | 7.9 | 350.8 | 116 | 1.50 | |
| 01:22:00 | 44.3 | 7.9 | 350.0 | 116 | 1.50 | |
| 01:23:00 | 44.4 | 7.9 | 350.8 | 117 | 1.50 | |
| 01:24:00 | 44.3 | 7.9 | 350.0 | 117 | 1.50 | |
| 01:25:00 | 44.3 | 7.9 | 350.0 | 118 | 1.55 | |
| 01:26:00 | 44.3 | 7.8 | 345.5 | 118 | 1.55 | |
| 01:27:00 | 44.2 | 7.8 | 344.8 | 119 | 1.66 | |
| 01:28:00 | 44.2 | 7.8 | 344.8 | 119 | 1.60 | |
| 01:29:00 | 44.2 | 7.8 | 344.8 | 120 | 1.60 | |
| 01:30:00 | 44.2 | 7.8 | 344.8 | 120 | 1.65 | Fourth sample |

The invention claimed is:

1. A process for production of free fatty acids from saponifiable materials, the process comprising:

adjusting pH of a saponifiable material to a value above pH 7 by adding alkaline material;

saponifying all saponifiable material by passing alternate electrical current through the material, wherein the said step of saponification occurs in a saponification reactor; and said electrical current comprises applied voltage in the range of 10 to 1500 V wherein the said saponification reactor comprises a pressure vessel with hydraulic connections, sensors for pressure and temperature, an inside tube made of electrically conductive material, that is a zero electrode electrically connected to the reactor casing and a phase electrode also made of an electrically conductive material in a center of the reactor wherein the saponifiable material fills the inside tube, acidulating the saponified material by adding acid to pH value below 4;

isolating obtained free fatty acids from aqueous layer.

2. The process for production of free fatty acids as specified in claim 1, wherein saponification is carried in a pH range of 7.5-10.

3. The process as specified in claim 2, wherein saponification occurs in a temperature range of 70° C.-160° C.

4. The process as specified in claim 3, wherein saponification occurs in pressure range 1-6 bara.

5. The process as specified in claim 4, wherein a frequency of an alternating electric current is in the range 30 Hz to 10,000 Hz.

6. The process as described in claim 5, wherein acidulation occurs at pH range 3-6.

7. The process as described in claim 6, wherein acidulation agent is hydrochloric acid or sulphuric acid.

8. The process as specified in claim 7, wherein the saponification is carried out in a continuous mode.

9. The process as specified in claim 1, wherein the saponification reactor is an ohmic heater.

10. The process for production of free fatty acids as specified in claim 1, wherein said saponifiable materials are selected from the group consisting of soapstocks, gums, phospholipids, black liquor soaps or tall oil soaps.

11. The process for production of free fatty acids as specified in claim 1, wherein saponification is carried in a pH range of 7.9-8.9.

12. The process for production of free fatty acids as specified in claim 4, wherein a frequency of an alternating electric current is in the range of from 50 to 60 Hz.

13. The process for production of free fatty acids as specified in claim 5, wherein acidulation occurs at pH in the range of 4.5-5.5.

* * * * *